US006782869B2

(12) United States Patent
Blakley

(10) Patent No.: US 6,782,869 B2
(45) Date of Patent: Aug. 31, 2004

(54) FUEL DELIVERY SYSTEM AND METHOD

(75) Inventor: Daniel Robert Blakley, St. Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 33 days.

(21) Appl. No.: 10/232,914

(22) Filed: Aug. 30, 2002

(65) Prior Publication Data

US 2004/0040540 A1 Mar. 4, 2004

(51) Int. Cl.[7] ..... F02B 17/00

(52) U.S. Cl. ..... 123/430; 123/432; 123/443; 123/494

(58) Field of Search ..... 123/430, 432, 123/495, 443, 298, 469, 304, 300, 494, 305, 537, 522

(56) References Cited

U.S. PATENT DOCUMENTS

| | | | | | |
|---|---|---|---|---|---|
| 4,621,599 | A | * | 11/1986 | Igashira et al. | 123/300 |
| 5,797,367 | A | * | 8/1998 | Iida et al. | 123/295 |
| 6,067,954 | A | * | 5/2000 | Kudou et al. | 123/299 |
| 6,085,718 | A | * | 7/2000 | Nishimura et al. | 123/295 |
| 6,116,517 | A | | 9/2000 | Heinzl et al. | 239/101 |
| 6,213,099 | B1 | | 4/2001 | Calvas et al. | |
| 6,257,205 | B1 | | 7/2001 | Calvas et al. | |
| 6,340,014 | B1 | * | 1/2002 | Tomita et al. | 123/295 |
| 6,386,176 | B1 | * | 5/2002 | McGee | 123/299 |
| 6,491,016 | B1 | * | 12/2002 | Buratti | 123/299 |
| 6,516,783 | B2 | * | 2/2003 | Dutart et al. | 123/446 |

FOREIGN PATENT DOCUMENTS

| | | | | |
|---|---|---|---|---|
| JP | 267328 | * | 10/1989 | F02D/41/02 |
| JP | 159619 | * | 6/1998 | F02D/41/02 |
| JP | 212984 | * | 8/1998 | F02D/41/02 |
| JP | 231745 | * | 9/1998 | F02D/41/02 |
| WO | WO01/92715 A1 | | 12/2001 | F02M/53/06 |

OTHER PUBLICATIONS

Fulcher, et al., "Fuel atomization, vaporization." SAE Paper 952482, pp. 1–20.

* cited by examiner

*Primary Examiner*—Hai Huynh

(57) ABSTRACT

A fuel delivery system includes a drop ejector for discretely ejecting drops of combustible liquid in a digital manner. A controller is configured to cause the drop ejector to provide a first air/fuel mixture to a combustion chamber for a first portion of a fuel intake period and to provide a second air/fuel mixture to said combustion chamber for a second portion of the same fuel intake period.

21 Claims, 5 Drawing Sheets

FUEL DELIVERY SYSTEM AND METHOD

FIELD OF THE INVENTION

The present invention generally relates to, for example, fuel delivery in internal combustion engines.

BACKGROUND

Internal combustion engines generate power by causing a mixture of air and combustible fuel to ignite and burn in one or more combustion chambers, such as combustion cylinders in an automobile. Conventional internal combustion engines use combustion chambers that have two valve-controlled orifices: one intake orifice/valve for drawing fuel into the combustion chamber and one exhaust orifice/valve for expelling exhaust gas after the air/fuel mixture has ignited and burned. When the intake valve is open (and the exhaust valve is closed), an air/fuel mixture is drawn into the combustion chamber. The time period during which an air/fuel mixture is drawn into the combustion chamber is referred to as the "intake period." Then, the input valve is closed, and the air/fuel mixture is ignited. The force of the air/fuel ignition forces linear motion of a piston slideably disposed in the combustion chamber. Then, the exhaust valve is opened, and exhaust gases generated during the ignition of the air/fuel mixture are expelled from the combustion chamber through the exhaust orifice/valve by the downward motion of the piston. This time period is referred to as the "exhaust period." When the piston reaches the bottom of the combustion chamber, the intake valve is opened (and the exhaust valve is closed), and the cycle is repeated.

In a gasoline engine, it is commonly-known that the fuel ignites and burns most efficiently, thereby minimizing undesirable exhaust emissions, when the average air/fuel ratio in the combustion chamber is 14.7 (known as "stoichiometry"). If the average air/fuel ratio in the combustion chamber is significantly less than stoichiometry, then the air/fuel mixture is considered "rich" and the air/fuel mixture does not burn efficiently. On the other hand, if the average air/fuel ratio in the combustion chamber is significantly greater than stoichiometry, then the air/fuel mixture is considered "lean", and the air/fuel mixture does not ignite and burn fully. As a result, a greater amount of undesirable exhaust emissions are expelled from the combustion chamber.

To improve the fuel efficiency of internal combustion engines, it is desirable to be able to cause the engine to function efficiently with a lean air/fuel ratio during steady-state operation (i.e., when the engine is operated at substantially the same engine speed and load) while, at the same time, minimizing undesirable exhaust emissions. A so-called "lean burn" engine uses less fuel, since it functions with an air/fuel mixture that includes less fuel than the stoichiometric air/fuel ratio.

A known method for implementing a lean burn engine with known fuel injectors comprises alternatively injecting a lean air/fuel mixture and a rich air/fuel mixture into the combustion chamber during the same intake period. Specifically, for each intake period, a lean air/fuel mixture is injected into the combustion chamber for the majority of the intake period. For a relatively shorter portion of the intake period, a rich air/fuel mixture is injected into the combustion chamber. While the lean air/fuel mixture does not fully ignite and burn on its own, the rich air/fuel mixture ignites immediately and causes the otherwise lean air/fuel mixture in the combustion chamber to fully ignite and burn efficiently. As a result, the average air/fuel ratio during each intake period is lean, resulting in increased overall fuel efficiency. Nonetheless, because the air/fuel mixture burns to completion, the undesirable exhaust emissions are minimized.

Heretofore, the lean burn methodology described above has been implemented in internal combustion engines by using combustion chambers having three orifices/valves: two intake orifices/valves and an exhaust orifice/valve. One intake orifice/valve is used to receive the lean air/fuel mixture into the combustion chamber during most of the intake period, and the second intake orifice/valve is used to receive the rich air/fuel mixture into the combustion chamber during a relatively short portion of the intake period. Thus, the lean air/fuel intake valve is open and the rich air/fuel intake valve is closed for most of each intake period, and the rich air/fuel intake valve is open and the lean air/fuel intake valve is closed for the remaining portion of each intake period. The exhaust valve functions the same as it does in conventional two-valve combustion chambers. In response to control signals generated by an electronic controller, a cam shaft normally controls the opening and closing of the three valves, while a solenoid valve controls the amount of fuel allotted for intake during the intake cycle.

While the above-described method and system for implementing a lean burn engine performs adequately, the use of three-valve combustion chambers is relatively more complicated and expensive than conventional two-valve combustion chambers. Further, the mechanical controls necessary to precisely implement the alternative opening and closing of two intake valves during the same intake period are relatively complicated and difficult to implement. As a result, it would be desirable to have an improved method and system for implementing a lean burn internal combustion engine.

SUMMARY

Briefly and in general terms, the present invention relates to a fuel delivery system having a drop ejector for discretely ejecting drops of combustible liquid in a digital manner. A controller is configured to cause the drop ejector to provide a first air/fuel mixture to a combustion chamber for a first portion of a fuel intake period and to provide a second air/fuel mixture to said combustion chamber for a second portion of the same fuel intake period.

BRIEF DESCRIPTION OF THE DRAWINGS

The invention is better understood with reference to the following drawings. The elements of the drawings are not necessarily to scale relative to each other. Rather, emphasis has instead been placed upon clearly illustrating the invention. Furthermore, like reference numerals designate corresponding similar parts through the several views.

DETAILED DESCRIPTION

A lean burn internal combustion engine is implemented according to the present invention using a fuel injector capable of dispensing discrete fuel droplets of a fixed quantum. The ability to dispense discrete fuel droplets of a fixed quantum facilitates greatly improved control over the amount of fuel injected into a combustion chamber at any given time relative to other known devices for supplying fuel to a combustion chamber. As a result, and in contrast to known systems and methods, air/fuel mixtures of different ratios can be precisely delivered through a single intake orifice/valve during different portions of a single intake period.

Figure 1:
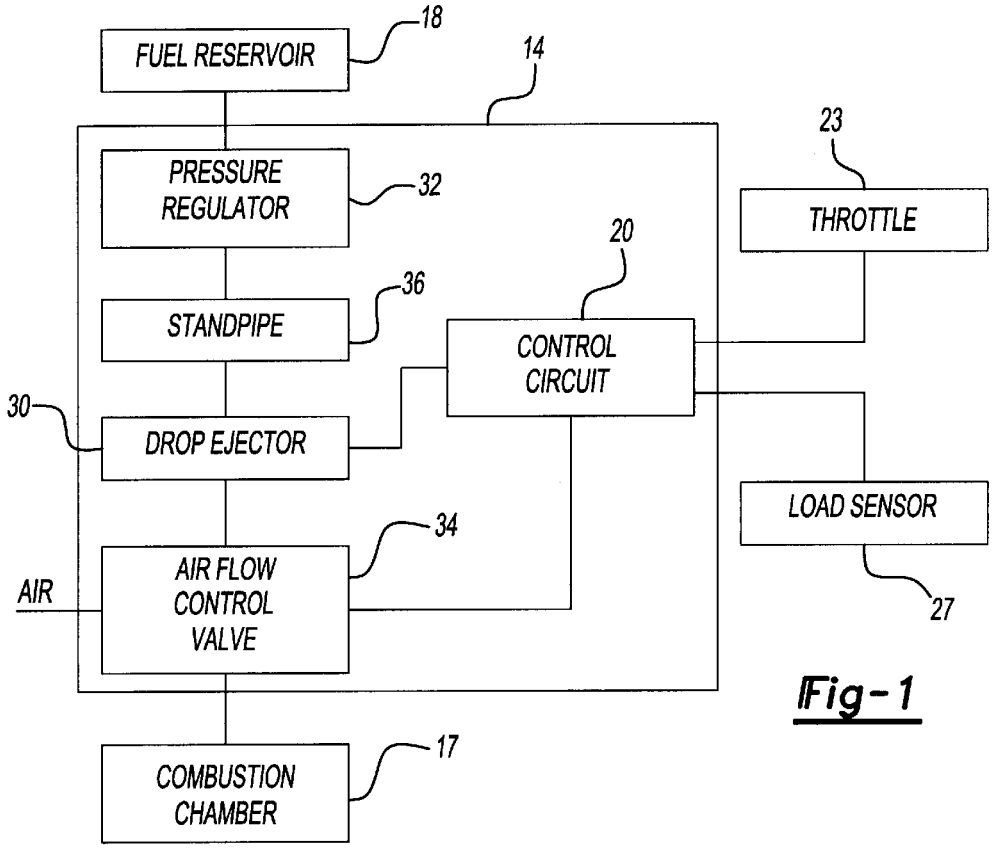
FIG. 1 is a block diagram of an exemplary embodiment of the fuel delivery system of the present invention.

FIG. 1 is a high-level block diagram of one embodiment of the system used to implement a lean burn internal combustion engine according to the present invention. Reference numeral 14 generally indicates an apparatus for generating a combustible vapor 100 for an internal combustion engine, hereinafter called a "fuel injector" for brevity. A fuel injector 14 includes a drop ejector 30 and an airflow control valve 34. The drop ejector 30 creates discrete droplets of fuel, each being of a substantially fixed quantum of size. The drop ejector 30 is fluidically connected, preferably under low pressure, to a fuel reservoir 18, such as a fuel tank, containing combustible fuel. The fuel from the fuel reservoir 18 is preferably delivered to the drop ejector 30 using a pressure regulator 32 and an operational standpipe 36 to prevent fuel leakage from the drop ejector 30 in non-use situations. Preferably, the drop ejector 30 is removable and replaceable by a typical consumer. A control circuit 20 controls the drop ejector 30 and airflow control valve 34. The control circuit 20 is preferably connected to a throttle 23 and a load sensor 27. The throttle 23, such as an accelerator pedal in an automobile, is actuated by a user. The optional load sensor 27 monitors and senses the load of the combustible fuel device powered by the internal combustion engine when appropriate. The airflow control valve 34 regulates the flow of air that is mixed with the fuel droplets ejected from the drop ejector 30 to create a combustible vapor, which is delivered into a combustion chamber 17, such as a typical combustion cylinder in an automobile. The combustion chamber 17 preferably includes a single intake orifice/valve for receiving incoming fuel and a single exhaust orifice/valve that provides a passage for exhaust gases after the fuel is burned. The fuel that is delivered to the combustion chamber is ignited by an ignition device (not shown), such as a sparkplug, in a manner known in the art. While FIG. 1 shows only one combustion chamber 17 (for purposes of illustration), the present invention may be implemented with one or more combustion chambers 17, wherein additional combustion chambers 17 would correspond to additional drop ejectors 30 and airflow control valves 34, all of which being controlled by control circuit 20.

A function of the fuel injector 14 is to produce very small, metered quantum, or "digital", droplets of combustible fuel and to channel a controlled amount of air through the droplets, thereby generating a combustible vapor. The combustible vapor is drawn into the combustion chamber(s) 17 to power the engine.

Figure 2:
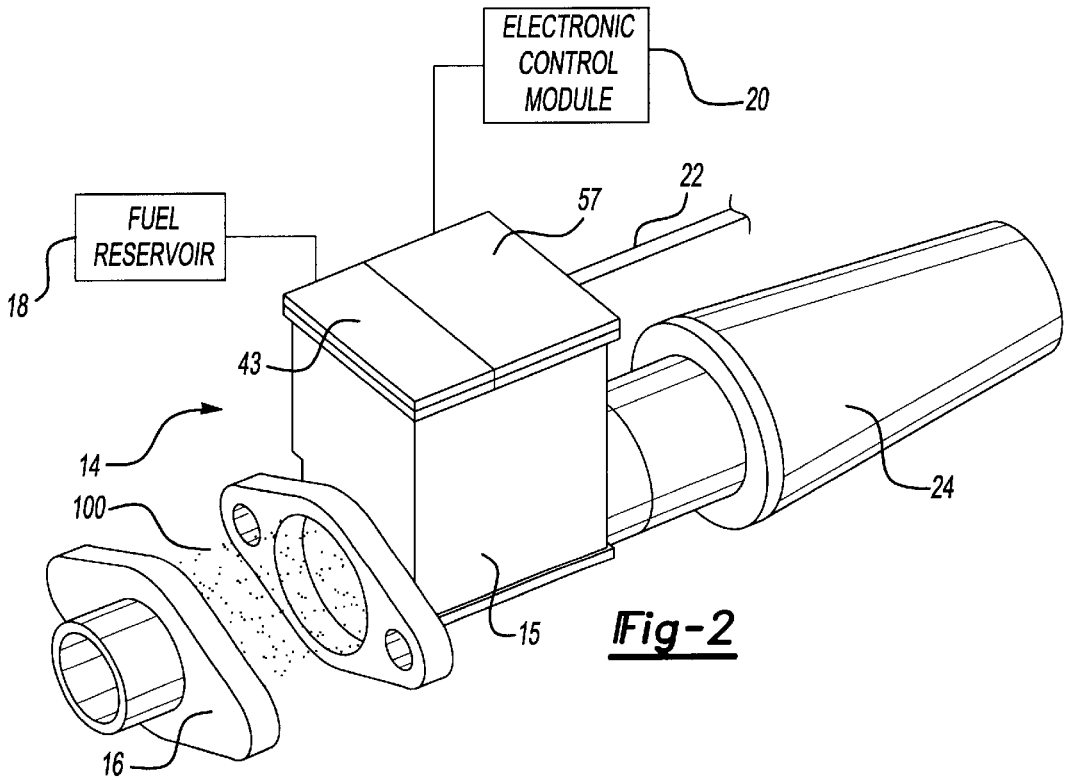
FIG. 2 is a top, side and perspective view, partially diagrammatic, of an apparatus for generating a combustible vapor for an internal combustion engine according to an exemplary embodiment of the invention.
Figure 3:
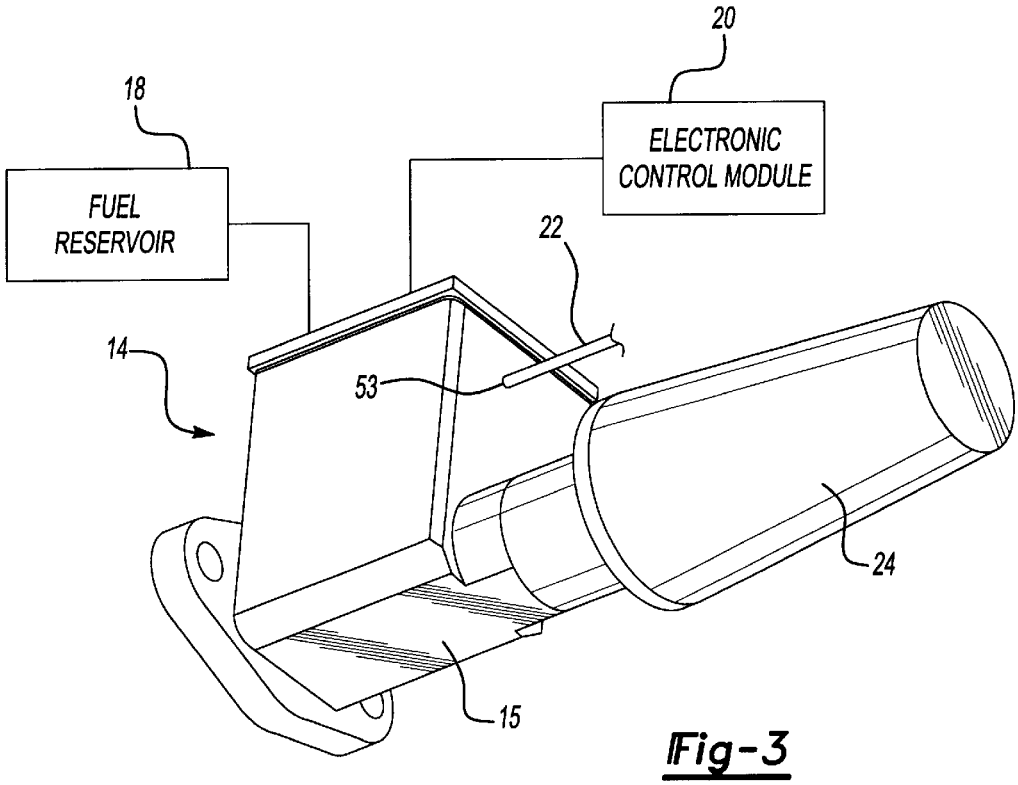
FIG. 3 is a bottom, side and perspective view, partially diagrammatic of the apparatus of FIG. 2.

Now, an embodiment of the fuel injector 14 of the present invention will be described in additional detail. FIGS. 2–8 illustrate various views and perspectives of the fuel injector 14 and its components. Referring first to FIGS. 2 and 3, the fuel injector 14 has a main body 15 that is mounted either on an intake manifold 16 of, or proximate to, the intake valve 101 of the combustion chamber 17. The main body 15 includes a first top member 43 and a second top member 57 (both of which are further described hereinafter). The fuel injector 14 is connected to control circuit 20, which generally controls the operation of the fuel injector 14 based upon input signals received from the throttle 23 and optional load sensor 27, as well as upon input signals received from a variety of other sensors and input devices. Throttle cable 22 is preferably connected to either a manual throttle or a foot pedal (not shown) and through a small hole 53 to the fuel injector 14. Physical actuation of the throttle cable 22 causes control signals to be provided to control circuit 20, which in turn controls the operation of the drop ejector 30 and air control valve 34. For example, as described below, when the throttle cable 22 is pulled away from the main body 15, the control circuit 20 causes the fuel injector 14 to further open the airflow control valve channel and thereby channel additional air into the engine. Preferably, a conventional air filter 24 removes any particulate matter in the air stream entering the fuel injector 14.

The fuel injector 14 is connected to a fuel reservoir 18, such as a fuel tank in an automobile. The fuel reservoir 18 may or may not be connected to a fuel pump (not shown). However, it is preferable to gravity feed the fuel from the fuel reservoir 18 to the fuel injector 14 because the fuel injector 14 of the present invention requires only a minimal fuel pressure, and gravity feed methods are less expensive than fuel pumps. The fuel can be any type of gasoline, Diesel fuels, alcohols, fuel oils and kerosenes. In short, any combustible fuel or fuel combination that will power an internal combustion engine or other combustible fuel device, such as lanterns, stoves, heaters and generators, are acceptable in connection with the present invention. The main body 15 of the fuel injector 14, and all of its parts, unless noted otherwise in this document, are preferably made of Nylon 6, an injected molded polymer that is resistant to gasoline and other engine fuels.

Figure 4:
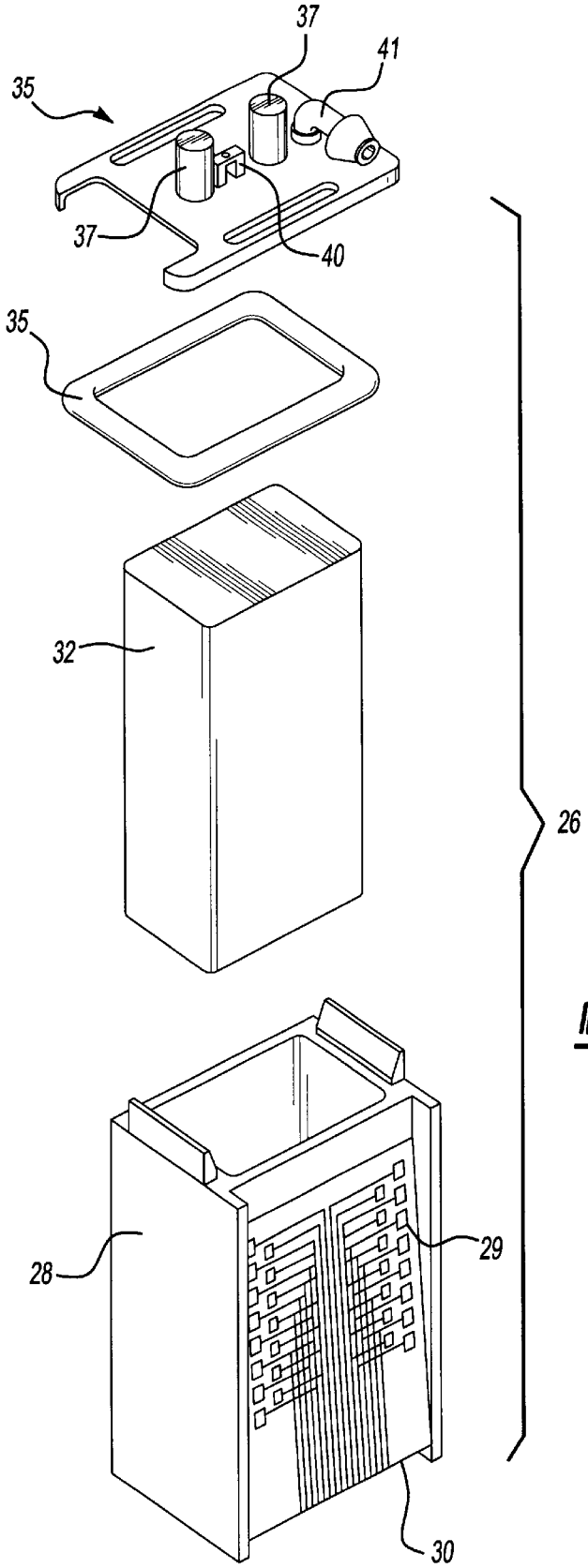
FIG. 4 is an exploded view of the micro-pump of the apparatus of FIG. 2.

With reference to FIG. 4, a slide body 26 contained inside of fuel injector 14 primarily performs the function of creating the combustible vapor that is provided to the combustion chamber(s) 17. Slide body 26 is contained inside of fuel injector housing 15. The slide body 26, which is preferably easily replaceable by a consumer, functions both as a micro-pump, which expels small fuel droplets, and an air control valve 34, which regulates the amount of air directed into the stream of fuel droplets produced by the micro-pump to create the fuel vapor. The slide body 26 is similar to and operates in essentially the same manner as a thermal ink jet print cartridge known to those of skill in that art. In this exemplary embodiment, the slide body 26 includes a housing 28, upon which is mounted a TAB circuit 29. Other forms of interconnection are known to those skilled in the art and can be substituted for the TAB circuit 29 and still remain within the spirit and scope of the invention. The TAB circuit 29 is electrically connected to the control circuit 20 and a drop ejector 30 located on the bottom wall of the housing 28. The TAB circuit 29 controls the drop ejector 30 based upon control signals from the control circuit 20.

An exemplary drop ejector is described in commonly-owned U.S. Pat. No. 6,162,589 entitled "Direct Imaging Polymer Fluid Jet Orifice" issued on Dec. 19, 2000 to Chen et al, and herein incorporated by reference. A preferred drop ejector 30 contains a plurality of fuel firing chambers. Each firing chamber has one or more nozzles, a fuel inlet channel, and an energy dissipation element, such as a resistor or flextentional device that is pulsed by the control circuit 20. The control circuit 20 is preferably responsive to engine load and throttle position when embodied in an internal combustion engine. The drop ejector 30 expels a fixed quantum of combustible liquid (i.e., drop-by-drop) from each firing chamber. For gasoline applications, the droplets preferably each have a Number Median Diameter (NMD) of less than about 30 microns and a volume of about 14 picoliters, although this can be tailored depending on the design of the drop ejector 30, such as up to an NMD of 1 mm.

Housing 28 further encompasses a pressure regulator 32, which is preferably comprised of reticulated foam (as illustrated in FIG. 4) but can also comprise many other forms of pressure regulators, such as a spring bag or a flexible diaphragm. The pressure regulator 32 is in fluid communication with the drop ejector 30 through a slot or slots in the standpipe (not shown) located in the bottom of the housing 28. The pressure regulator 32 places a slight negative pressure on the backside of the drop ejector 30 so that the combustible fluid does not leak or dribble out of the drop ejector.

The slide body 26 further includes a slide body top 35, which is designed to close the top opening of the housing 28. A gasket 33 seals the interface between the slide body top 35 and the housing 28 to prevent the fuel inside of the slide body 26 from leaking out. The gasket 33 is preferably made from EPDM or polyurethane, though other materials could also be used and remain within the spirit and scope of the invention.

While the general operation of the fuel injector 14 of the present invention essentially functions, as described above, similarly to a thermal ink jet print cartridge, various properties of the desired fuel used, such as surface tension, chemical reactivity, and volatility, to name a few, require that modifications be made to the design of conventional thermal ink jet print cartridges and thus prevents simply replacing ink with fuel. Such changes include reducing the capillary sizes in the standpipe 36 between the backpressure regulator 32 and the drop ejector 30 to account for a lower surface tension. Other changes include selection of materials for the body 15 and backpressure regulator 32 that are resistant to the fuel's solubility, such as Nylon 6. Further, the backpressure regulation should be adapted to account for the higher volatility of the fuel. Other desirable modifications would be readily-recognized by one of ordinary skill in the art.

Still referring to FIG. 4, various physical elements are disposed on the outer side of the slide body top 35. Outer cylindrical members 37 are incorporated to retain compression springs 46 (FIG. 6), as described in more detail below. Loop member 40 functions to couple the throttle cable to the slide body 26. As a result, actuation-of the throttle cable 22 causes the slide body 26 to move within the fuel injector main body 15 so as to adjust the amount of air entering the fuel injector 14, as described in more detail below. Finally, a fuel inlet conduit 41 is also disposed on the outer side of the slide body top 35. The fuel inlet conduit 41 is in fluid communication with the fuel reservoir 18 (FIGS. 2 and 3) and functions to permit the flow of fuel into the slide body 26. The fuel inlet conduit 41 is preferably flexible and resiliently deformable so that the slide body 26 can move up and down within the fuel injector without restriction from the fuel inlet conduit 41.

Figure 5:
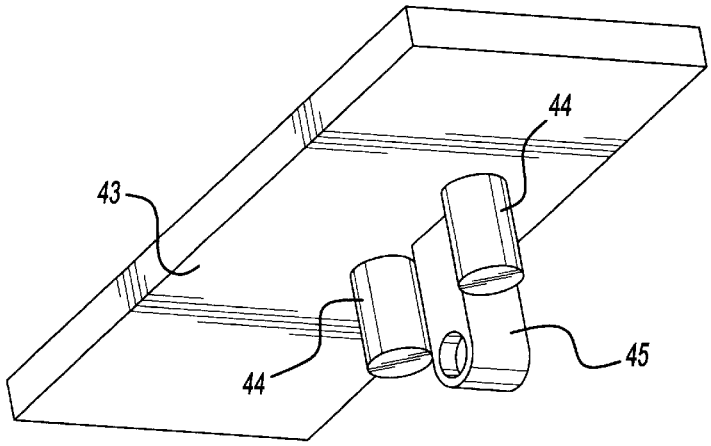
FIG. 5 is a perspective view of a component of the apparatus of FIG. 2.

FIG. 5 illustrates a preferred inner (downside) wall of the first top member 43 of fuel injector main housing 15 (shown in FIGS. 2 and 3). The inner wall of first top member 43 preferably includes inner cylindrical members 44 and throttle cable guide 45. The inner cylindrical members 44 are preferably co-axial with the outer cylindrical members 36 on the outer side of the slide body top 35 (FIG. 4) when the fuel injector 14 (FIGS. 2 & 3) is fully assembled. Inner cylindrical members 44 and outer cylindrical members 37 function together to engage and retain the two compression springs 46 (described in more detail below) that provide a bias against the slide body 26 relative to the first top member 43 of the fuel injector main housing 15.

Figure 6:
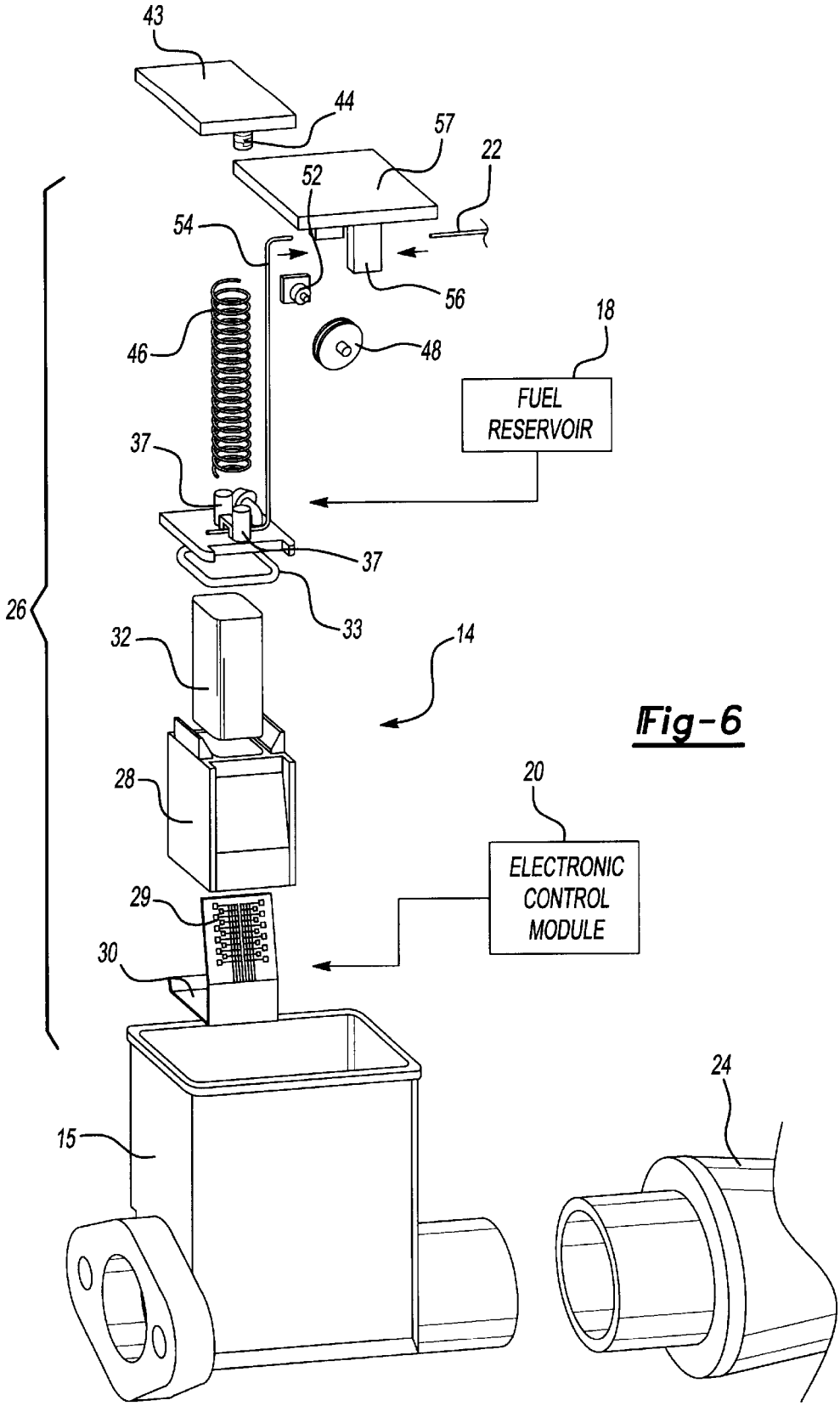
FIG. 6 is an exploded view, partially diagrammatic, of the apparatus of FIG. 2.
Figure 7:
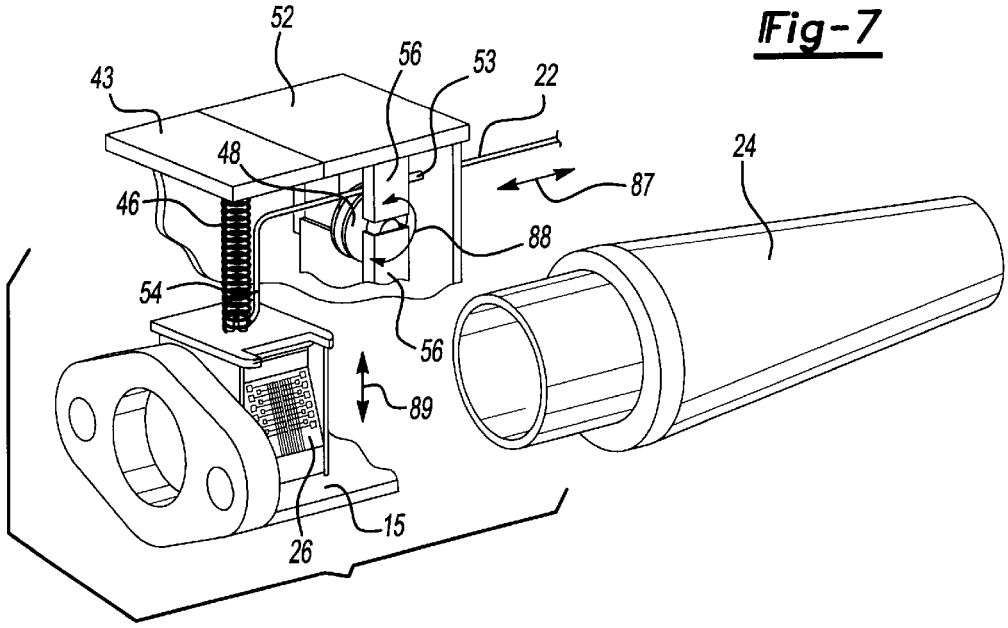
FIG. 7 is a perspective view, partially cut away, of the apparatus of FIG. 2.

FIGS. 6 and 7 both illustrate a full embodiment of the fuel injector 14 and its various components. FIG. 6 shows an exploded view of the fuel injector 14, while FIG. 7 shows an assembled cut-away view of the fuel injector 14. With reference to both FIG. 6 and FIG. 7 (where like elements have like reference numerals), the relationship of the various components of the fuel injector 14 will be described. As described above, air filter 24 is coupled to main housing 15, which provides a protected chamber to hold the various fuel injector components. The slide body 26—including drop ejector 30, TAB circuit 29, slide body housing 28, pressure regulator 32, gasket 33, and slide body top 35—is slideably disposed inside of main housing 15. The control circuit 20 communicates with TAB circuit 29 to control drop ejector 30. Fuel reservoir 18 is fluidly connected to fuel inlet conduit 41 disposed on the outer side of the slide body top 35. When assembled, compression springs 46 (preferably manufactured from stainless steel) engage with outer cylindrical members 37 and inner cylindrical members 44 to urge the slide body 26 downward into the main body 15 and into a position that blocks the flow of air through the fuel injector 14.

Figure 8:
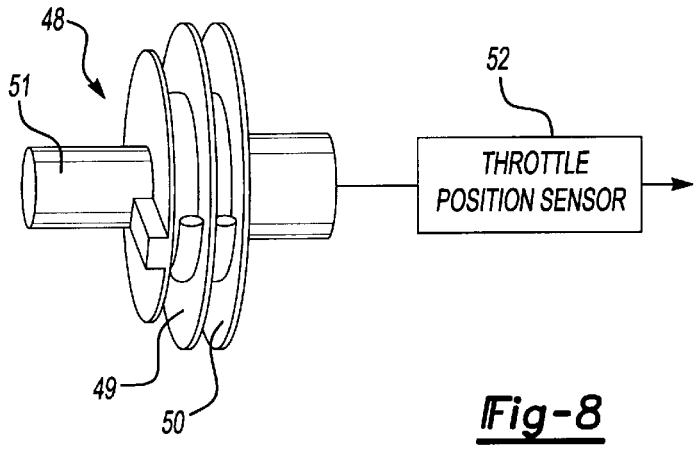
FIG. 8 is a perspective view of a component of the apparatus of FIG. 2.

Throttle cable 22 is connected (directly or indirectly) to loop member 40 to facilitate the raising of slide body 26 (thereby further opening the air passage through the fuel injector 14) in response to actuation by a user. The throttle cable 22 may be connected directly to slide body 26, or, as shown in FIGS. 6, 7 and 8, a throttle wheel 48 may be used to functionally couple throttle cable 22 (actuated by a user) to a second throttle cable 54, which is then physically coupled to the loop member 40 of slide body 26. Throttle wheel 48 is assembled to forks 56 of the second top member 57 of main housing 15. Throttle wheel 48 is configured to rotate around its center point, as illustrated by arrows 88. Both throttle cables 22, 54 are wrapped around throttle wheel 48. A throttle position sensor 52, preferably a potentiometer, is positioned inside of the main housing 15 so as to sense the position of the throttle cable 22. The throttle position sensor 52 provides an output signal to the control circuit 20, which uses this signal to adjust the amount of fuel ejected from drop ejector 30.

A purpose of the throttle wheel 48 described above is to adjust the amount of linear movement of the slide body 26 relative to the amount of linear movement of the throttle cable 22. A preferred throttle wheel 48 illustrated in FIG. 8 causes a smaller linear movement of slide body 26 relative to the actuating linear movement of throttle cable 22, thereby allowing a smaller overall fuel injector height. The throttle wheel 48 preferably has a smaller spool 49 and a larger spool 50 rigidly mounted on an axle 51. The throttle cable 22, which is connected to the throttle (not shown) passes through a small hole 53 (FIG. 7) in the main body 15 and is wrapped around the larger spool 50. The second throttle cable 54 is wrapped around the smaller spool 49. The second throttle cable 54 passes through the guide member 45 (FIG. 5) and is connected to the loop member 40 on the outer side of slide body top 35 (FIG. 4). The different diameters of the two spools 49, 50 allow the overall height of the fuel injector 14 to be reduced. When a throttle wheel 48 is used in the system, the throttle position sensor 52 is preferably connected to the throttle wheel axle 51, which measures the radial position of the throttle wheel 48 corresponding to the vertical position of the slide body 26 within the fuel injector 14 and communicates that information to the electronic control module 20.

Figure 9:
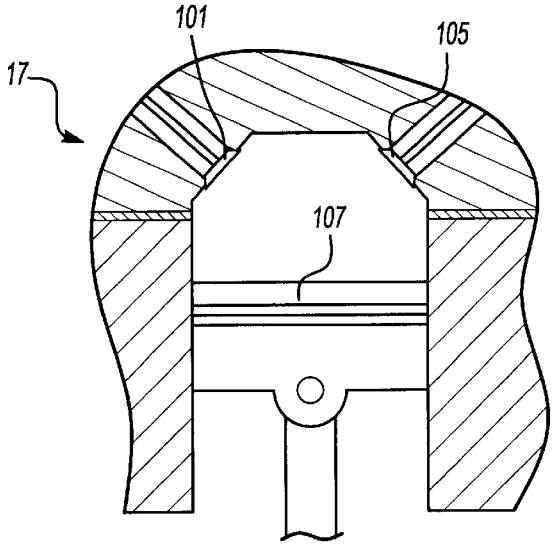
FIG. 9 is a front view of a combustion chamber, according to an embodiment of the present invention.

The embodiment of the fuel injector 14 described above provides a combustible vapor to combustion chamber 17, which is now described in more detail with reference to FIG. 9. Combustion chamber 17 can take a variety of forms, though for purposes of illustrating the invention in connection with a specific embodiment, a cylindrical combustion chamber of the type commonly used in automobiles is preferred. The combustion chamber 17 preferably includes at least one intake orifice/valve 101 and at least one exhaust orifice/valve 105. The intake orifice/valve 101 is adapted to be in fluid communication with the fuel injector 14 to receive fuel into the combustion chamber 17. The exhaust orifice/valve 105 is adapted to allow exhaust gases to be expelled from the combustion chamber 17. As is conventional in the art, a reciprocating piston 107 is slideably disposed in the combustion chamber 17 and adapted to move in response to the combustion of liquid fuel in the combustion chamber 17.

Now, with reference to FIGS. 1–9, a preferred operation of the system will be described in more detail. In operation, the flow path of air through the fuel injector 14 begins at the air filter 24. Air is drawn into the fuel injector either by an air pump (not shown) or by the vacuum created by the motion of the piston(s) 107 in the combustion chamber(s) 17. Air flows through the air filter 24, into the main body 15, beneath the drop ejector 30, out of the main body 15, and into the intake manifold 16. The flow path of the fuel begins at the fuel reservoir 18. The fuel flows in a low pressure conduit (e.g. less than about 3 psi) from the fuel reservoir 18 to the main body 15, then through a resiliently deformable conduit at a low pressure (e.g. again less than about 3 psi) to the fuel inlet 41 on the slide body 26 (FIG. 9). The fuel flows through the pressure regulator 32, through several slots in the standpipe (not shown) in the bottom of the housing 28 to the drop ejector 30. The pressure regulator 32 maintains a slight negative pressure (to create a backpressure) at the back of the drop ejector 30 so that the fuel does not drool or run out of the drop ejector 30 during non-use. The fuel is drawn out of the pressure regulator 32 and into the drop ejector 30 by the capillary action of the fuel within the drop ejector 30 and standpipe slots. The drop ejector 30 fires small, discrete, fixed quantums of the fuel in a drop-by-drop fashion vertically downward into a fast flow of air channeled beneath the slide body 26. When the droplets reach the air stream, their flight path changes from vertical to horizontal in this example. The airflow is designed such that mixing occurs between the air and the droplets of fuel, resulting in a combustible vapor. The combustible vapor is provided to the combustion chamber 17 through intake valve 101.

Referring to FIG. 7, actuation of throttle cable 22, as indicated by the arrow 87, causes the throttle wheel 48 to rotate, as indicated by the arrow 88, and the slide body 26 to move up and down, as indicated by the arrow 89. The slide body 26 normally sits at the bottom of fuel injector housing 15, blocking the airway between the air filter 24 and the combustion chamber 17. The slide body 26 is biased toward this position by compression springs 46. When the throttle cable 22 is pulled away from the main body 15, the throttle cable 22 causes the throttle wheel 48 to rotate, which, in turn, causes the second throttle cable 54 to pull the slide body 26 upward and compress the compression springs 46. The second throttle cable 54 passes through the guide 45, and its motion is redirected from horizontal to vertical as illustrated in FIG. 7. The second throttle cable 54 is attached to the loop member 40 on the slide body top 35. When the slide body 26 moves upward, more of the airway between the air filter 24 and the combustion chamber 17 is uncovered and more air is permitted to flow into the fuel injector 14. The position sensor 52 detects the rotation of the throttle wheel 48 and sends a signal to the control circuit 20 indicating that more air is flowing into the fuel injector. The control circuit 20 adjusts the amount of fuel ejected from the drop ejector 30, and thus, the amount of fuel vapor provided to the combustion chamber 17 using any number of air/fuel ratio control strategies.

To employ a lean burn engine using the above-described system, the control circuit 20 is adapted to cause the fuel injector(s) 14 of the system to supply a lean air/fuel mixture to the combustion chamber(s) 17 during a portion of each intake period and to supply a rich air/fuel mixture to the combustion chambers(s) 17 during another portion of each intake period. That is, each time the intake valve 101 of the combustion chamber 17 is open (and the exhaust valve 105 is closed), the combustion chamber 17 receives a lean air/fuel mixture for a given period of time and a rich air/fuel mixture for a different given period of time, all during the same intake period. For a lean burn engine, the period of time during which the lean air/fuel mixture is provided to the combustion chamber 17 is normally longer than the period of time during which the rich air/fuel mixture is provided. In contrast to known methods of implementing a lean burn engine, the present invention preferably provides the lean air/fuel mixture and the rich air/fuel mixture through a single intake valve. Because the fuel injector 14 is capable of providing small discrete droplets of fuel, the air/fuel mixture provided through a single intake valve can be quickly and accurately adjusted so as to deliver different air/fuel mixtures at distinct times through the same intake valve during the same intake period.

In addition to simply providing discrete lean and rich air/fuel mixtures, the control circuit 20 can be configured to cause the fuel injector 14 to provide several different air/fuel mixtures during a single intake period. For example, the control circuit 20 can be configured to cause the fuel injector 14 to provide a rich air/fuel ratio to the combustion chamber for a first period of time and then continuously increase the air/fuel ratio throughout the remaining portion of the intake period to achieve the most effective and efficient combustion. Similarly, the control circuit 20 can be configured to cause the fuel injector 14 to provide a lean air/fuel ratio to the combustion chamber for a first period of time and then continuously decrease the air/fuel ratio throughout the remaining portion of the intake period.

A variety of control circuits 20 and methods can be used to adjust the composition (air/fuel ratio) of the air/fuel mixture delivered from the fuel injector 14. Two such methods are described in co-pending patent application Ser. No. 10/086,002 filed on Feb. 26, 2002 and co-pending patent application Ser. No. 10/120,951 filed on Apr. 10, 2002, both assigned to Assignee, and the teachings of both being hereby incorporated by reference. In general, the air/fuel ratio can be adjusted by (i) varying the number of fixed quantum fuel droplets that are ejected by the drop ejector 30 during a given time period, (ii) varying the amount of air delivered through the fuel injector 14, or (iii) a combination of both. Preferably, the number of fuel droplets is varied relative to a given amount of air to adjust the air/fuel ratio.

The number of fuel droplets ejected during a given time period can be adjusted in a variety of ways. For example, the number of active firing chambers on the drop ejector 30 can be adjusted. That is, to make the air/fuel ratio more rich, additional firing chambers could be "turned on" by the control circuit 20 so that a greater number of fuel droplets are expelled during the same period of time. To make the air/fuel ratio more lean, some of the firing chambers could be "turned off" by the control circuit 20 so that fewer fuel droplets are expelled during the same period of time. Alternatively, the number of fuel droplets ejected during a given time period can be adjusted by changing the frequency of which the firing chambers eject fuel droplets. Thus, to make the air/fuel ratio more rich, the control circuit 20 could cause the drop ejector 30 to expel fuel droplets at a greater frequency. To make the air/fuel ratio more lean, the control circuit 20 could cause the drop ejector 30 to expel fuel droplets less frequently. Of course, combinations of adjusting the number of active firing chambers and adjusting the firing frequency could be used to adjust the air/fuel ratio delivered from the fuel injector 14. The above-referenced copending applications assigned to Applicant describe multiple embodiments of control circuits 20 capable of adjusting the number of fuel droplets ejected from a drop ejector 30 during a given time frame, which could be used to implement the present invention.

While the present invention has been described herein in connection with an embodiment employing a combustion chamber having a single intake valve, the present invention can also be employed in engines having multiple intake valve combustion chambers. Where multiple intake valve combustion chambers are used, it is preferable to open and close all of the intake valves simultaneously and deliver a lean or rich air/fuel mixture (depending on the portion of the intake period) through all of the intake valves at the same time. More specifically, during each intake period, all of the intake valves would be open for the entire intake period. A lean air/fuel mixture would be supplied to the combustion chamber through all of the intake orifices/valves for a portion of the intake period. Further, a rich air/fuel mixture would be supplied to the combustion chamber through all of the intake orifices/valves for a different portion of the intake period. In this way, an embodiment of the invention employing combustion chambers having multiple input orifices/valves functions essentially identical to an embodiment having single intake orifice/valve combustion chambers, except that the multiple intake orifice/valve combustion chambers receive fuel through multiple intake orifices/valves that effectively function in parallel.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements. Further, the use of the words "first", "second", and the like do not alone imply any temporal order to the elements identified. The invention is limited by the following claims.

What is claimed is:

1. A fuel delivery system, comprising:

a drop ejector having a nozzle capable of discretely ejecting liquid fuel in a digital manner; and a controller configured to cause said drop ejector to provide a first air/fuel mixture to a combustion chamber for a first portion of a fuel intake period and to provide a second air/fuel mixture to said combustion chamber for a second portion of said fuel intake period, wherein said controller is configured to cause said drop ejector to provide a third air/fuel mixture to said combustion chamber for a third period portion of said fuel intake period.

2. The system of claim 1, wherein said first air/fuel mixture is lean of stoichiometry, and wherein said second air/fuel mixture is rich of stoichiometry.

3. The system of claim 2, wherein said lean air/fuel mixture is provided to said combustion chamber before said rich air/fuel mixture is provided to said combustion chamber.

4. The system of claim 2, wherein said rich air/fuel mixture is provided to said combustion chamber before said lean air/fuel mixture is provided to said combustion chamber.

5. The system of claim 2, wherein said first portion of said intake period is longer in duration than said second portion of said intake period.

6. The fuel injection system of claim 1, wherein said first air/fuel mixture is lean of stoichiometry, said third air/fuel mixture is rich of stoichiometry, and said second air/fuel mixture is between said first and third air/fuel mixtures.

7. The system of claim 1, wherein said combustion chamber includes a single intake orifice through which said first and second air/fuel mixtures are provided to said combustion chamber.

8. The system of claim 1, wherein said combustion chamber includes a plurality of intake orifices through which said first and second air/fuel mixtures are provided to said combustion chamber.

9. A fuel delivery system, comprising:

a drop ejector having a nozzle capable of discretely ejecting liquid fuel in a digital manner; and a controller configured to cause said drop ejector to provide a first air/fuel mixture to a combustion chamber for a first portion of a fuel intake period and to provide a second air/fuel mixture to said combustion chamber for a second portion of said fuel intake period, wherein said controller is configured to adjust said air/fuel mixture supplied to said combustion chamber by changing a number of discrete droplets of fuel expelled from said drop ejector during a given time period.

10. The system of claim 9, wherein said controller is configured to change said number of discrete fuel droplets by changing a number of active firing chambers on said drop ejector.

11. The system of claim 9, wherein said controller is configured to change said number of discrete fuel droplets by changing a frequency with which said drop ejector expels fuel droplets.

12. The system of claim 9, wherein said controller is configured to change said number of discrete fuel droplets by changing a number of active firing chambers on said drop ejector and changing a frequency with which said drop ejector expels fuel droplets.

13. A method of delivering an air/fuel mixture to a combustion chamber, comprising:

delivering a combustible vapor having a first air/fuel ratio during a first portion of an intake period;

delivering a combustible vapor having a second air/fuel ratio during a second portion of said intake period;

delivering a combustible vapor having a third air/fuel ratio during a third period portion of said intake period; and wherein said combustible vapor is created by passing air through discrete droplets of a combustible liquid.

14. The method of claim 13, wherein:

said first air/fuel mixture is lean of stoichiometry; and said second air/fuel mixture is rich of stoichiometry.

15. The method of claim 13, wherein said combustible vapor having a first air/fuel ratio and said combustible vapor having a second air/fuel ratio are both delivered through a single intake orifice in the combustion chamber.

16. A method of delivering an air/fuel mixture to a combustion chamber, comprising:

delivering a combustible vapor having a first air/fuel ratio during a first portion of an intake period;

delivering a combustible vapor having a second air/fuel ratio during a second portion of said intake period, wherein:

said lean air/fuel mixture is created by passing said air through a first number of fuel droplets; and said rich air/fuel mixture is created by passing said air through a second number of fuel droplets, wherein said second number of fuel droplets is greater than said first number of fuel droplets, wherein said second number of fuel droplets is generated by activating additional firing chambers on a drop ejector.

17. The method of claim 16, wherein said second number of fuel droplets is generated by increasing a frequency with which fuel droplets are ejected.

18. An internal combustion engine, comprising:

a combustion chamber;

fuel ejector means for discretely ejecting liquid fuel in a digital manner; and means for causing said fuel ejector means to deliver a first air/fuel mixture to said combustion chamber for a first portion of an intake period and causing said fuel ejector means to deliver a second air/fuel mixture to said combustion chamber for a second portion of said intake period and causing said fuel ejector means to deliver a third air/fuel mixture to said combustion chamber for a third portion of said intake period.

19. The internal combustion engine of claim 18, wherein said first air/fuel mixture is lean of stoichiometry and said second air/fuel mixture is rich of stoichiometry.

20. The internal combustion engine of claim 18, wherein said combustion chamber includes a single intake orifice for receiving an air/fuel mixture.

21. A fuel powered apparatus, comprising:

an internal combustion engine having a least one combustion chamber;

a fuel delivery system that delivers an air/fuel mixture to said combustion chamber; and wherein said fuel delivery system comprises:

a drop ejector having a nozzle capable of discretely ejecting liquid fuel in a digital manner; and a controller configured to cause said fuel delivery system to deliver a lean air/fuel mixture to said combustion chamber for a first portion of an intake period and deliver a rich air/fuel mixture to said combustion chamber for a second portion of said intake period, said controller being further configured to deliver a third air/fuel mixture to said combustion chamber for a third portion of said intake period, said third air/fuel mixture being richer than said lean air/fuel mixture and leaner than said rich air/fuel mixture.

* * * * *